United States Patent [19]

Matsuo et al.

[11] Patent Number: 4,861,396

[45] Date of Patent: Aug. 29, 1989

[54] ALUMINUM ALLOY MATERIAL PLATE FOR PRINTING

[75] Inventors: Mamoru Matsuo; Yutaka Okuda, both of Saitama; Kazushige Takizawa; Hirokazu Sakaki, both of Shizuoka, Japan

[73] Assignees: Fuji Photo Film Co., Ltd., Kanagawa; Sky Aluminum Co., Ltd., Tokyo, both of Japan

[21] Appl. No.: 89,111

[22] Filed: Aug. 25, 1987

Related U.S. Application Data

[63] Continuation of Ser. No. 720,231, Apr. 5, 1985, abandoned.

[30] Foreign Application Priority Data

| | | | |
|---|---|---|---|
| Apr. 6, 1984 | [JP] | Japan | 59-69821 |
| Apr. 6, 1984 | [JP] | Japan | 59-69822 |
| Apr. 6, 1984 | [JP] | Japan | 59-69823 |
| Apr. 6, 1984 | [JP] | Japan | 59-69824 |

[51] Int. Cl.[4] ..... B41N 1/08; C22C 21/06; C22C 21/16

[52] U.S. Cl. ..... 148/439; 101/459

[58] Field of Search ..... 101/459; 148/439

[56] References Cited

U.S. PATENT DOCUMENTS

| | | | |
|---|---|---|---|
| 459,239 | 9/1891 | Mullaly | 101/459 |
| 1,069,857 | 8/1913 | Cornwall | 101/459 |
| 3,229,628 | 1/1966 | Mundell | 101/459 |
| 3,397,044 | 8/1968 | Bylund . | |
| 3,475,289 | 10/1969 | Hunter | 156/665 |
| 4,435,230 | 3/1984 | Fujikua | 101/459 |
| 4,526,103 | 7/1985 | Kubota | 101/459 |

FOREIGN PATENT DOCUMENTS

| | | | |
|---|---|---|---|
| 67056 | 12/1982 | European Pat. Off. | 101/459 |
| 67632 | 12/1982 | European Pat. Off. | 101/459 |
| 00318 | 1/1984 | European Pat. Off. . | |
| 29301 | 3/1977 | Japan | 101/459 |
| 42493 | 3/1983 | Japan | 101/459 |
| 67349 | 1/1984 | Japan | 101/459 |
| 1052795 | 12/1966 | United Kingdom . | |
| 1421710 | 1/1976 | United Kingdom . | |

*Primary Examiner*—Clifford D. Crowder

*Attorney, Agent, or Firm*—Sughrue, Mion, Zinn, Macpeak & Seas

[57] ABSTRACT

A printing aluminum alloy material plate is described which provides good printing characteristics, that is, surface-treatment ability, burning ability and ink stain resistivity; the plate is obtained from an aluminum alloy material which is cold-rolled at a reduction rate of from 20 to 95% after being subjected to intermediate annealing at a temperature of 300° to 550° C. wherein the aluminum alloy material comprises 0.25 wt % or less Si, from 0.05 to 1.0 wt % Fe, 0.03 wt % or less Cu, 0.10 wt % or less Ti, and 0.03 wt % or less Mg and the balance of unavoidable impurities and Al.

2 Claims, 3 Drawing Sheets

ALUMINUM ALLOY MATERIAL PLATE FOR PRINTING

This is a continuation of application Ser. No. 06/720,231, filed Apr. 5, 1985, now abandoned.

BACKGROUND OF THE INVENTION

The present invention relates to an aluminum alloy material plate used for support members for offset printing or lithographic printing plate (hereinafter referred to as "Printing aluminum alloy material plate").

Heretofore, rolled plates having a plate-thickness of from about 0.1 to 0.5 mm, which satisfy the requirements of the Japanese Industrial Standard (JIS) A1050P, A1100P, A3003P, etc., have been generally used as printing aluminum alloy material plates. Such printing material plates are typically produced by a method wherein an ingot which is obtained by a semi-continuous casting process and the outer surface of which is then removed by scalping (removal of the outer surface), is heated to a predetermined temperature and then hot-rolled after being subjected, if required, to a uniformalizing treatment (treatment to provide homogeneities), thereafter, the thus processed ingot is cold-rolled at a reduction rate of plate thickness of from 20 to 95% so as to obtain a rolled plate of an intermediate thickness. Alternatively, the ingot is directly cast by a continuous casting process to obtain a coiled sheet having a plate thickness of 12 mm or less, and is then subjected directly to a cold rolling process so as to obtain a rolled plate of intermediate thickness with no heat-rolling process being applied thereto, and the plate of intermediate thickness, after being subjected to an intermediate annealing process, is subjected to a final cold-rolling process at a reduction rate of from 20 to 95% in order to obtain necessary mechanical properties.

Upon actual use of the above-mentioned printing aluminum alloy material plate for printing, the material plate, which beforehand is surface-roughened by a mechanical process, a chemical process, and an electrochemical process, or a combination of two or more of these processes, and is then preferably subjected to anodic oxidation treatment, is coated with a photo-sensitive material and then is exposed, thereafter being developed, and the material plate is then subjected to a heat treatment at a temperature of from 250° to 300° C. in a short time (usually referred to as a "burning treatment") so that the strength of the photo-sensitized film is increased to enhance its printing press life and is wound around a cylindrical plate drum, whereafter printing is conducted on sheets of paper after ink for printing is applied to the image area of the material plate in the presence of dampening water and is then transferred to a rubber blanket.

Printing aluminum alloy material plates to be used as mentioned above are required to having the following characteristics (A), (B), and (C):

(A) A uniformly roughened-surface can be formed by surface-treatment, no irregularity is brought about after surface-treatment, and a suitable color tone is exhibited. The ability of being able to be subjected to such uniform and appropriate surface-roughening treatment is hereinafter referred to as "surface-treatment ability";

(B) Lowering in strength as a result of the burning treatment should be small. Such an ability is hereinafter referred to as "burning ability"; and (C) No ink stains occur on non-imaged area during printing. This ability is hereinafter referred to as "ink stain resistivity".

Of these above-mentioned characteristics, if the surface-treatment ability (A) is inferior, the tone of the surface-roughened material plate is excessively whitish or blackish, and, in certain cases, has irregularity in color which results in lowering the commercial value of the material plate. Since the surface-roughened after surfaceroughening significantly affects the printing press life and the image sharpness and clearness satisfactory surface-treatment and the uniform roughness after surface-treatment are very important conditions to be achieved for the printing plate. It is noted that in the case of surface-roughening treatment by electrolytic etching, the affect of the property of the plate material itself (surface-treatment ability) is, of course, not negligible in view of the electrochemical reaction between the outer surface of aluminum and electrolyte, although the condition of the roughened surface is naturally changed with great variety depending upon the electrolytic conditions and the type(s) of electrolyte employed. However, the conventional printing aluminum alloy material plates have not been fully studied concerning the surface treatment ability for surface-roughening, and, therefore, may not always have a sufficient surface-treatment ability from a practical viewpoint.

Concerning the burning ability (B), Japanese Patent Publication Nos. 27243/69 and 274244/69 describe in detail that an image area can be effectively reinforced by such a method that a PS plate having an aluminum alloy plate as a base material which is beforehand exposed and developed by a conventional process, is subjected to heat-treatment (referred to as a "burning treatment") at a high temperature. The heating time and temperature for such burning treatment depend upon the type of resin forming the image area, but are, as a rule, within a temperature range of from 200° to 280° C. and a time limit of from 3 to 7 minutes. However, burning treatment at a higher temperature has recently become desirable in order to enhance the printing press life as well as to shorten the time necessary for the burning treatment. However, if a conventional aluminum alloy material plate is heated at a temperature 280° C. or more, recrystallization occurs, resulting in extreme lowering of the strength of the plate. Therefore, when such aluminum plate is used as a support for lithographic prinitng plates, there are problems in that handling of the prinitnig plate is very difficult. It becomes impossible to mount the printing plate on a priniting cylinder of a press, and it is impossible to make resistering the printing plate in the case of multicolor printing. In view of this disadvantage, the development of new aluminum alloy material plates which are high in heatresistivity and a printing aluminum alloy which is excellent in burning ability, has been eagerly desirable.

Ink stain resistivity is essential to printing plates, since stains on printed matter due to adhering of ink to the non-image area of the printing plate should be avoided. However, in conventional printing aluminum alloy material plates, study of the ink stain resistivity has been not sufficiently conducted, and therfore, no practical solution has been discovered to overcome such an ink stain problem until now. The inventors have studied the problem of ink stain and found that this problem is mainly caused by localized corrosion which is caused by a chemical reaction between the printing plate and dampening water. Accordingly, the inventors have discovered that this problem of ink stains can be overcome by suitable selecting the material compositions of the printing plate.

SUMMARY OF THE INVENTION

The present invention has been made in view of the above-mentioned problems experienced using conventional printing plates.

Accordingly, the object of the present invention is to provide printing aluminum alloy material plates which are excellent in one or more of the above-mentioned surfacetreatment ability, burning ability, or ink stain resistivity.

The present inventors have conducted extensive studies in order to attain above-mentioned object, concerning the chemical composition of aluminum alloy material plates and the conditions of intermediate annealing during the manufacturing process of the material plate, which affect the above-mentioned three characteristics, and discovered that the contents of Si, Cu, and Mg in the material of the plate affect the surface-treatment ability, the content of Si and the temperature of intermediate annealing greatly affect the burning ability, and the content of Si greatly affects the ink stain resistivity. Thus, the present invention has been achieved.

With respect to the surface-treatment ability, the inventors have found that as the Si content is increased, a more uniformly roughened surface can be obtained, and further that the range of Si content which results in a uniformly roughened surface is affected by the difference between the Cu content and Mg content (i.e., the Cu wt %-Mg wt %). That is, as the amount of (Cu-Mg) is increased, a more satisfactorily roughened surface can be obtained even if Si content is low.

Concerning the burning ability, the lower the Si content is in the material, or the higher the temperature of intermediate annealing, the lower the decrease in strength after the burning treatment can be made. Finally, concerning the ink stain resistivity, the less Si content the more satisfactory ink stain resistivity can be obtained.

In more specifically, according to the present invention, there is provided a printing aluminum alloy material plate which is a rolled aluminum alloy plate obtained by cold-rolling at a reduction rate of from 20 to 95%, after the rolled aluminum alloy plate is subjected to intermediate annealing at a temperature of 300° to 550° C. The alloy compositions in the rolled aluminum alloy plate comprises 0.25 wt % or less Si, from 0.05 to 1.0 wt % Fe, 0.03 wt % or less Cu, 0.10 wt % or less Ti, 0.03 wt % or less Mg (as an impurity) and the balance of unavoidable impurities and aluminum.

The above and other objects and features of the present invention will become apparent from the following detailed description of exemplary embodiments of the present invention with reference to the accompanying drawings.

DETAILED DESCRIPTION OF PREFERRED EMBODIMENTS

Figure 2:
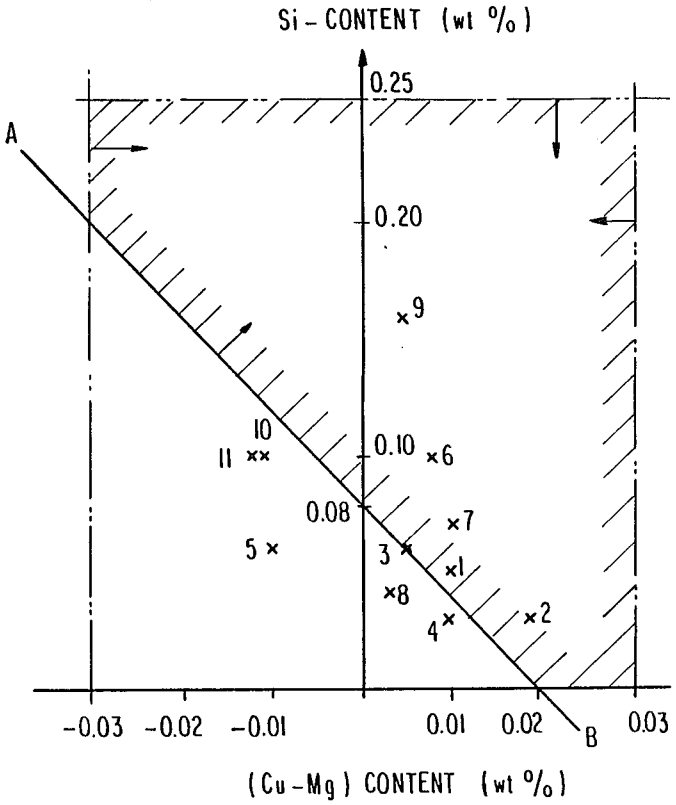
FIGS. 2, 4, and 6 are charts as in FIG. 1, illustrating Si content and temperature of intermediate annealing for aluminum alloy in the Examples of the present invention, as in FIG. 1.

The printing aluminum alloy material plates of the present invention, which have excellent surface-treatment ability, burning ability, and/or ink stain resistivity, of all of such properties, particularly belong to the following four embodiments, in consideration with their properties:

(1) Printing aluminum plates which are particularly excellent in the surface-treatment ability can be obtained by using aluminum alloy material plates in a range which satisfies the following expression, in addition to the properties of the above-mentioned printing aluminum alloy material plates:

$$\text{Si wt \%} \geqq 0.08 - 4(\text{Cu wt \%-Mg wt \%}) \quad (1)$$

(2) Printing aluminum alloy material plates which are excellent in the burning ability, can be obtained by using aluminum alloy material plates having Si content (Si wt %) in a range which satisfies the following expression (in accordance with the temperature T (°C.) of intermediate annealing), in addition to the properties of the above-mentioned printing aluminum alloy material plates:

$$\text{Si wt \%} \leqq 2T/625 - 1.28 \quad (2)$$

(3) Printing aluminum alloy material plates which are improved in the ink stain resistivity can be obtained by using the above-mentioned aluminum alloy material plates in which the Si wt % is 0.08 wt % or less.

(4) Further, the printing aluminum alloy material plates which are excellent in the above-mentioned all characteristics: surface-treatment ability, burning ability and ink stain resistivity, can be obtained by using the abovementioned printing aluminum alloy material plates in which Si wt % is in the range satisfying the expressions (1) and (2) above in accordance with the Cu wt %, the Mg wt %, and the temperature T (°C.) of intermediate annealing, and the difference between the Cu wt % and the Mg wt % is in the range satisfying the expression (3):

$$0 \leqq (\text{Cu wt \%-Mg wt \%}) \leqq 0.03 \quad (3)$$

Figure 1:
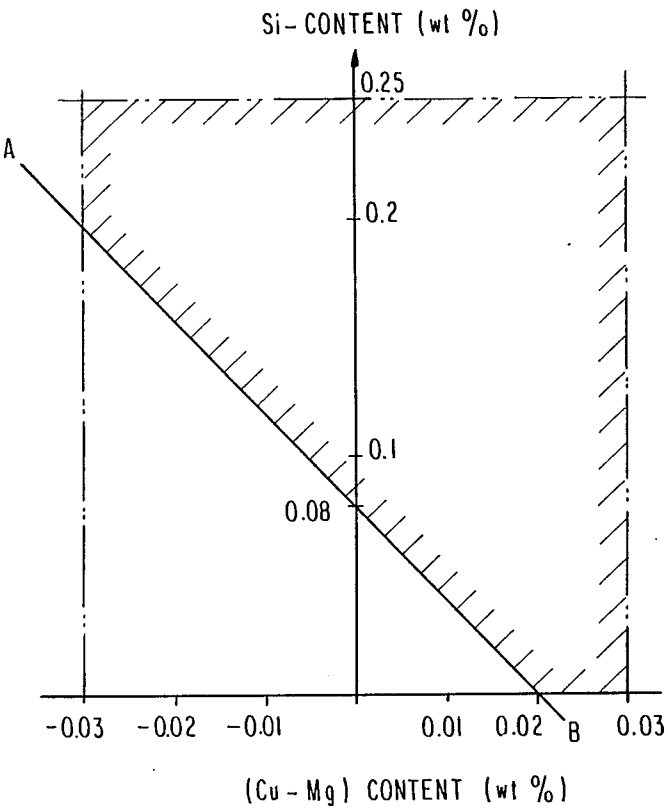
FIGS. 1, 3, and 5 are charts illustrating the conditional range of Si content (Si wt %) in aluminum alloy material according to the present invention, with respect to the value of (Cu wt %-Mg wt %)

With respect to the surface-treatment ability, the inventors carried out precise experiments and found that excellent surface-treatment ability can be obtained if the Si content in the material should satisfy the above-mentioned expression (1) in accordance with the value of (Cu wt %-Mg wt %). The range of Si content obtained by the expression (1) is shown, corresponding to the value of (Cu wt %-Mg wt %), in FIG. 1 in the upper right area with respect to the line AB. In the lower left area with respect to the line AB, the roughness of the roughened surface is made irregular after surface-roughening treatment, and therefore, the uniformly roughened surface cannot be obtained.

Since the Cu content and Mg content are each within a range of from 0 wt % to 0.03 wt % as is explained hereinbelow, the amount of (Cu wt %-Mg wt %) is in a range of −0.03 to 0.03. Further, if Si content exceeds 0.25%, the color tone of the plate after surface-roughened treatment is too blackish to observe the imaged section upon inspection of the latter after development. Therefore, in view of the factors of surface-treatment ability and color tone, the upper limit of Si content should be 0.25%. Accordingly, in consideration with all these conditions, the ranges of Si content and the value of (Cu wt %-Mg wt %) fall in the slanted line area shown in FIG. 1.

With respect to the burning ability, inventors conducted precise experiments and found that, if Si content satisfies a range determined by the above-mentioned expression (2) in relation to the temperature T (°C.) of intermediate annealing, the lowering of strength after the burning treatment can be controlled to a degree which offers no practical problem. The range determined by this expression (2) falls in the area on the right side of the line AB shown in FIG. 3. In the area on the left side of the line AB, the lowering of strength after the burning treatment is excessive, that is, after the burning treatment of, for example, 7 min. at 270° C., 0.2% of yield-stress becomes unpreferably 5 kg/mm$^2$ or less.

Figure 3:
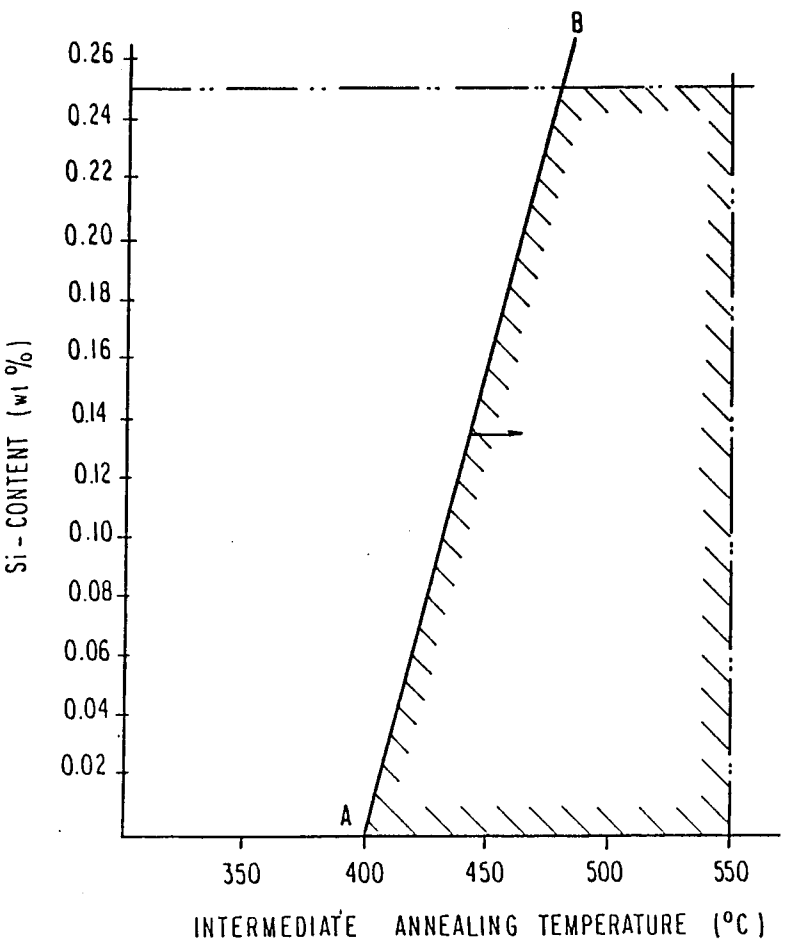

Further, more than 0.25% Si content would cause the change of color tone after the surface-roughening treatment to be too blackish, so that the image area is difficult to observe upon the inspection of the image area after development. Therefore, the upper limit of the Si content should be 0.25%. Further, the temperature of intermediate annealing should be within a range of from 300° to 550° C. Accordingly, in consideration with all these conditions, the Si content and the temperature T of the intermediate annealing temperature should fall in the slant line area as shown in FIG. 3.

The ink stain resistivity is greatly affected by the Si content. It has been found according to the present invention that, in order to improve the ink stain resistivity, the Si content should be 0.08 wt % or less. More than a 0.08 wt % Si content causes ink to adhere to the non-imaged section so that printed materials are liable to be stained.

Figure 5:
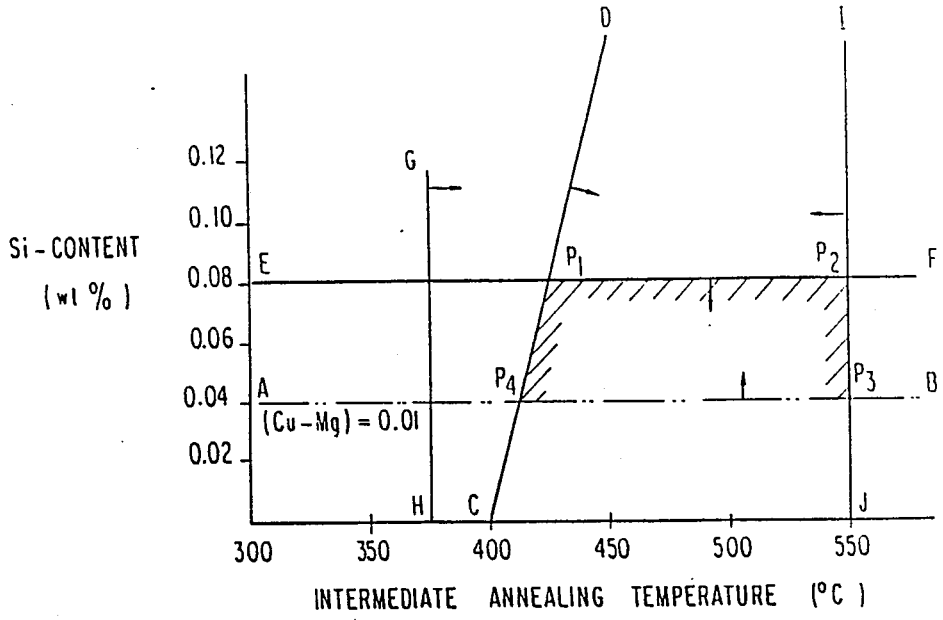

Concerning the surface-treatment ability, the higher the Si content in the material, the more uniform surface-roughness after surface-roughening treatment is obtained. This Si content is affected by the difference between Cu content and Mg content (Cu wt %-Mg wt %); that is, the higher the value of (Cu wt %-Mg wt %), the easier uniform roughness can be obtained with less Si content. The excellent surface-treatment ability can be obtained if Si content in the material satisifes the above-mentioned expression (1) in accordance with the value of (Cu wt %-Mg wt %). When the value of (Cu wt %-Mg wt %) is 0.01 wt %, the range of Si content obtained by the expression (1) and the range of the intermediate annealing temperature(T) are shown in FIG. 5 in the upper area with respect to the line AB. In the lower area with respect to the line AB, the roughness of the roughened surface is irregular after surface-roughening treatment, and, therefore, a uniformly roughened surface cannot be obtained. Further, this line AB is shifted, vertically, in dependence upon the amount of (Cu wt %-Mg wt %) in accordance with the expression (1), that is, the line AB lowers as the value of (Cu wt %-Mg wt %) increases.

The burning ability is affected by Si content and the temperature of intermediate annealing, that is, the lower the Si content, or the higher the temperature of the intermediate annealing, the lower is the decrease of strength resulting after the burning treatment. The inventors conducted precise experiments and found that, if Si content satisfies a range determined by the above-mentioned expression (2) in relation to the temperature T (°C.) of intermediate annealing, the lowering of strength after the burning treatment can be controlled to a degree which offers no practical problem. The range determined by this expression (2) falls in the area on the right side of the line CD shown in FIG. 5. In the area on the left side of the line CD, the lowering of stength after the burning treatment is excessive, that is, after the burning treatment of, for example, 7 min. at 270° C., 0.2% yield-stress becomes unpreferably lower than 5 kg/mm$^2$.

Furthermore, concerning the ink stain resistivity, the lower Si content in the material, the less ink stain results. The inventors have conducted experiments and found that the Si content in the material should be 0.08 wt % or less in order to obtain satisfactory ink stain resistivity. This range of 0.08 wt % or less Si content falls in the area below the line EF in FIG. 5. More than 0.08 wt % Si causes ink to adhere to the non-imaged section, with the result that printed materials are liable to be stained.

Further, the temperature T of the intermediate annealing should be within a range from 300° to 550° C., as will be explained hereinbelow, and this range falls in the area on the right side of the line GH and on the left side of the line IJ in FIG. 5. After all, summarizing the abovementioned all conditions in FIG. 5, the ranges of Si content and the temperature of annealing which satisfy all of the above-mentioned characteristics: surface-treatment ability, burning ability and ink stain resistivity, fall in the slanted line area surrounded by the four lines AB, CD, EF, IJ, or within the range $P_1$–$P_2$–$P_3$–$P_4$.

Further, as mentioned above, the position of the line AB is shifted upward and downward depending upon the value of (Cu wt %-Mg wt %) in accordance with the expression (1), and the line AB coincides with the line EF as the amount of (Cu wt %-Mg wt %) is reduced to zero. Accordingly, in order to obtain a result in the area of $P_1$–$P_2$–$P_3$–$P_4$, the amount of (Cu wt %-Mg wt %) should be 0% or more. On the contrary, as the amount of (Cu-Mg) increases, the line AB lowers, so that the area satisfying the above-mentioned three characteristics is enlarged. However, as will be explained, since the Cu content is 0.03 wt % at maximum, and the Mg content is 0 wt % at minimum, the upper limit of the amount of (Cu wt %-Mg wt %) is 0.03%. Accordingly, the amount of (Cu wt %-Mg wt %) is set in a range of from 0.03 to 0 wt % as determined by the expression (3). If the amount of (Cu wt %-Mg wt %) is 0.03 wt % or less, no effect is obtained with respect to the burning ability and the ink stain resistivity.

Further explanation is hereinbelow made concerning the reasons for limitations as to the other components, other than the Si, of the printing aluminum alloy material plates according to the present invention.

Less than 0.05 wt % of Fe causes the surface-treatment ability to be inferior, and the mechanical properties are also insufficient. On the other hand,more than 1.0% Fe deteriorates the ink stain resistivity, and therefore the color tone after surface-roughening treatment becomes excessively blackish, which is unfavorable. Accordingly, Fe content is set within a range from 0.05 to 1.0 wt %.

If the content of Ti, which is added to provide uniformity and fine crystal grains, exceeds 0.10 wt %, these effects are saturated, and wastefully increased costs are incurred. Therefore, the Ti content is limited 0.10 wt % or less. It is noted here than the use of Al-Ti-B mother alloy as a Ti adding means is more effective than the use of Al-Ti mother alloy in order to attain the above-mentioned purposes. In this case, the material inevitably contains therein B. The content of B is preferably limited to 0.02 wt % or less in order to prevent boride stringers due to $TiB_2$ particles.

If the content of Cu, which is added to improve the surface-treatment ability, exceeds 0.03 wt % the ink stain resistivity is deteriorated. Therefore, the upper limit of the Cu content is set at 0.03 wt %.

If the content of Mg, which is typically present as an impurity which deteriorates the surface-treatment ability, is 0.03 wt % or less, the surface-treatment ability is not deteriorated due to the coexistence with a suitable amount of Cu. More than 0.03 wt % Mg deteriorates the surface-treatment ability even though it may coexists with Cu, and therefore, Mg content should be set at 0.03 wt % or less. Other impurities in very small amounts which are inevitably included in the material do not adversely affect the surface-treatment ability and the burning ability.

Next, explanation is made with respect to the manufacturing conditions of the printing aluminum alloy material plates according to the present invention. Process steps prior to the intermediate annealing step does not affect to the surface treatment ability, the burning ability and the ink stain resistivity, and accordingly, any suitable process steps can be employed. That is, the process steps prior to the intermediate annealing step, are usually employed such that an ingot which is obtained by a semi-continuous casting process, the outer surface of which is then removed by scalping is heated to a predetermined temperature after subjecting, as required, to uniformalizing treatment, and thereafter, the thus processed ingot is cold-rolled at a reduction rate of plate thickness of from 20 to 95% so as to obtain a rolled plate of an intermediate thickness, or the ingot is directly cast by a continuous casting process to obtain a coiled sheet having a plate thickness of 12 mm or less and is then subjected directly to a cold rolling process so as to obtain the rolled plate of the intermediate thickness with no heat-rolling process being applied thereto. After thus-obtaining the plate of an intermediate thickness, the plate is subjected to intermediate annealing at a temperature of 300° to 550° C. for 24 hours or less, and then, in order to provide necessary mechanical strength, is subjected to final cold-rolling at a reduction rate of from 20 to 95%. The reason for the limiting condition of intermediate annealing is as follows. That is, if the temperature of intermediate annealing is below 300° C., sufficient recrystallization cannot be brought about. On the other hand, if it is above 550° C., secondary recrystallization occurs so that the recrystallized grains become remarkably coarse, and furthermore non-uniformity and blisters due to surface oxidation occur, so that it is unsuitable for printing material plates. Further, as mentioned above, the temperature of intermediate annealing is limited in relation to Si content in the material. Meanwhile, if the time of intermediate annealing is longer than 24 hours, the effect of annealing is saturated, and therefore, it is uneconomical to continue the annealing for more than 24 hours. Therefore, the time of intermediate annealing is preferably set for 24 hours at maximum.

The advantages of the present invention will be clearly understood from the examples explained hereinbelow.

EXAMPLE 1

Alloys according to the present invention and comparative alloys as indicated by sample numbers 1 to 11 in Table 1 were rendered molten, and then cast by semi-continuous casting into slabs 450 mm×1200 mm×3500 mm. Each slab, after being subjected to scalping by 7 mm per one surface, was subjected to homogenizing at 550° C. for 12 hours, followed by hot-rolling at 500° C. to produce a rolled plate having a plate-thickness of 5 mm. Then, after being subjected to cold-rolling to a plate-thickness of 1.2 mm, the plate was subjected to intermediate annealing in a stationary type annealing furnace at a temperature indicated in Table 2. The heating rate of this stationary type annealing was about 50° C./Hr., and the holding time after reaching the annealing temperature is 2 hours. Then the coil after intermediate annealing was cold-rolled to a plate-thickness of 0.3 mm, so as to obtain offset-printing material plates. The Si content and the value of (Cu wt %-Mg wt %) of the material plates of the sample numbers of 1 to 11 are plotted with x-marks in FIG. 2.

Each material plate obtained in this example, after being mechanically surface-roughening by brushing, was preetched in a 10% NaOH aqueous solution at 50° C. for 1 minute, and then was subjected to surface-roughening, electrochemically be carry out A.C. electrolyzation with the use of nitric acid type etching liquid at 35° C. Thereafter, an anodic oxidation coating having a thickness of 1 μm is formed on the material plate by anodic oxidation in 15% $H_2SO_4$ aqueous solution, and then photosensitizer was coated on the material plate so as to obtain an offset-printing PS plate. The thus-obtained PS plate, after being subjected to predetermined exposure and development, was subjected to a burning treatment at 280° C. for 7 minutes. With the use of the thus-obtained original plate, printing test of 100,000 copies was carried out under the presence of dampening water.

The results of examination concerning these alloys according to the present invention and comparative alloys are listed in Table 2. The evaluation to the surface-treatment ability was made by checking whether uniformity in surface-roughness after electrochemical surface-roughening can be obtained or not, and satisfactory of unsatisfactory results are indicated by "O" and "X" marks, respectively.

TABLE 1

| Sample No. | Material Composition (wt %) | | | | | | |
|---|---|---|---|---|---|---|---|
| | Si | Fe | Cu | Mg | (Cu—Mg) | Ti | B |
| 1 | 0.05 | 0.25 | 0.012 | 0.002 | 0.010 | 0.03 | 0.0002 |
| 2 | 0.03 | 0.30 | 0.024 | 0.005 | 0.019 | 0.02 | 0.001 |
| 3 | 0.06 | 0.41 | 0.008 | 0.003 | 0.005 | 0.03 | 0.002 |
| 4 | 0.03 | 0.31 | 0.012 | 0.002 | 0.010 | 0.03 | 0.0002 |
| 5 | 0.06 | 0.42 | 0.002 | 0.012 | −0.010 | 0.04 | 0.005 |
| 6 | 0.10 | 0.68 | 0.010 | 0.002 | 0.008 | 0.04 | 0.005 |
| 7 | 0.07 | 0.10 | 0.014 | 0.004 | 0.010 | 0.05 | 0.0002 |
| 8 | 0.04 | 0.53 | 0.013 | 0.010 | 0.003 | 0.03 | 0.004 |
| 9 | 0.16 | 0.95 | 0.006 | 0.002 | 0.004 | 0.05 | 0.001 |
| 10 | 0.10 | 0.32 | 0.003 | 0.014 | −0.011 | 0.03 | 0.001 |
| 11 | 0.10 | 0.43 | 0.002 | 0.014 | −0.012 | 0.01 | 0.001 |

TABLE 2

| Sample No. | Intermediate Annealing Temperature (°C.) | Surface-Treatment Ability |
|---|---|---|
| 1 | 450 | ○ |
| 2 | 500 | ○ |
| 3 | 475 | ○ |
| 4 | 500 | X |
| 5 | 475 | X |
| 6 | 450 | ○ |
| 7 | 350 | ○ |
| 8 | 325 | X |
| 9 | 400 | ○ |
| 10 | 400 | X |
| 11 | 450 | X |

As shown in Table 2, in the case of the printing aluminum alloy material plates (Sample Nos. 1, 2, 3, 6, 7 and 9), it is clear that they are excellent in the surface-treatment ability. Meanwhile, the comparative alloy samples (Sample Nos. 4, 5, 8, 10 and 11) are all inferior to in the surface-treatment ability, since the Si content does not satisfy the expression (1) in relation to the amount of (Cu wt %-Mg wt %).

Although exemplification is shown, in the abovementioned example, such that the intermediate annealing was conducted under stationary batch type annealing, the intermediate annealing can also be made by the so-called continuous annealing process in which the material is passed through a heating furnace held at a high temperature while the material being uncoiled so as to be annealed.

As is clearly understood from the above, since the printing aluminum alloy material plates according to the present invention are excellent in the surface-treatment ability for surface-roughening, surface-roughness can be uniformly formed without irregularity by surface-roughening while a suitable color tone is possibly obtained after surface-roughening, and therefore, satisfactory printed matters can be obtained after printing by the printing plate using these material plates. Accordingly, the printing aluminum alloy material plate of the present invention are very useful for the support members for off-set printing or lithographic printing.

EXAMPLE 2

Figure 4:
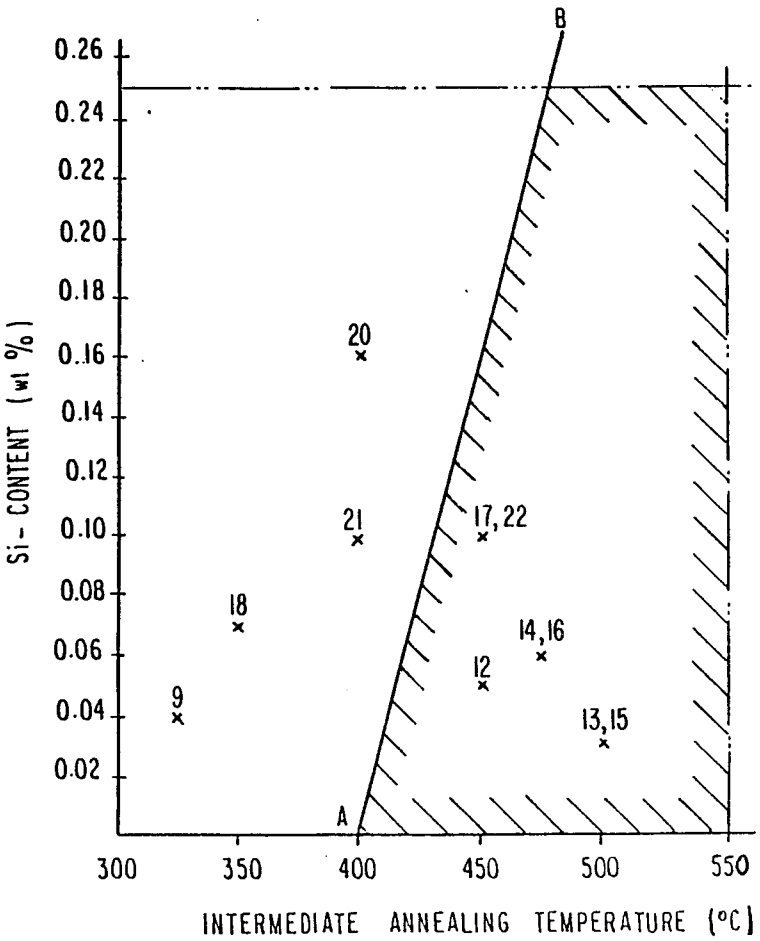

Alloys according to the present invention and comparative alloys as indicated by sample numbers 12 to 22 in Table 3 were rendered molten, and then cast, by semicontinuous casting, into slabs of 450 mm×1200 mm×3500 mm. Each slab, after being subjected to scalping by 7 mm per one surface, was subjected to uniformalizing at 550° C. for 12 hours, and then was hot-rolled at 500° C. to produce a rolled plate having a plate-thickness of 5 mm. Then, after being subjected to cold-rolling to a plate-thickness of 1.2 mm, the plate was subjected to intermediate annealing in a stationary type annealing furnace at a temperature indicated in Table 4. The temperature increasing rate of this stationary type annealing is about 50° C./Hr, and the holding time after reaching of the annealing temperature is 2 hours. Then the coil after intermediate annealing was cold-rolled to a plate-thickness of 0.3 mm so as to obtain offset-printing material plates. The Si content and the temperature of intermediate annealing for the material plates of the sample numbers of 12 to 24 are plotted with x-marks in FIG. 4.

Each material plate obtained in this example, after being mechanically surface-roughened by brushing, was preetched in 10% NaOH aqueous solution at 50° C. for 1 minute and then was subjected to surface-roughening, electrochemically by carrying out A.C. electrolyzation with the use of nitric acid type etching liquid at 35° C. Thereafter, an anodic oxidation coating having a thickness of 1 μm was formed on the material plate by anodic oxidation in 15% $H_2SO_4$ aqueous solution, and then photosensitizer is coated on the material plate so as to obtain an offset-printing PS plate. The thus-obtained PS (pre-sensitized) plate, after being subjected to predetermined exposure and development, was subjected to burning treatment at 280° C. for 7 minutes. With the use of the thus obtained original plate, a printing test of 100,000 copies was carried out under the presence of moistening water.

The results of examination concerning these alloys according to the present invention and comparative alloys are listed in Table 4. Specifically, in Table 4, the burning ability is shown as the result of examination concerning the strength for the value of 0.2% yield-stress after the burning treatment.

The strength value after the burning was evaluated by checking whether the printing plate can be set on the plate drum or not, and when the strength value is 10 kg/mm$^2$ or more, satisfactory results is obtained, i.e., setting is complete, which result is indicated by ○; when 5 to 10 kg/mm$^2$, the printing plate can be set with care, which result is indicated by Δ; when less than 5 kg/mm$^2$, the printing plate can not be set, which result is indicated by X.

TABLE 3

| Sample No. | Material Composition (wt %) | | | | | |
|---|---|---|---|---|---|---|
| | Si | Fe | Cu | Mg | Ti | B |
| 12 | 0.05 | 0.25 | 0.012 | 0.002 | 0.03 | 0.0002 |
| 13 | 0.03 | 0.30 | 0.024 | 0.005 | 0.02 | 0.001 |
| 14 | 0.06 | 0.41 | 0.008 | 0.003 | 0.03 | 0.002 |
| 15 | 0.03 | 0.31 | 0.012 | 0.002 | 0.03 | 0.0002 |
| 16 | 0.06 | 0.42 | 0.002 | 0.012 | 0.04 | 0.005 |
| 17 | 0.10 | 0.68 | 0.010 | 0.002 | 0.04 | 0.005 |
| 18 | 0.07 | 0.10 | 0.014 | 0.004 | 0.05 | 0.0002 |
| 19 | 0.04 | 0.53 | 0.013 | 0.010 | 0.03 | 0.004 |
| 20 | 0.16 | 0.95 | 0.006 | 0.002 | 0.05 | 0.001 |
| 21 | 0.10 | 0.32 | 0.003 | 0.014 | 0.03 | 0.001 |
| 22 | 0.10 | 0.43 | 0.002 | 0.014 | 0.01 | 0.001 |

TABLE 4

| Sample No. | Intermediate Temperature (°C.) | Yield Stress Burning (Kg/mm$^2$) | |
|---|---|---|---|
| 12 | 450 | 12.1 | (○) |
| 13 | 500 | 13.5 | (○) |
| 14 | 475 | 12.3 | (○) |
| 15 | 500 | 13.4 | (○) |
| 16 | 475 | 12.4 | (○) |
| 17 | 450 | 8.6 | (Δ) |
| 18 | 350 | 2.8 | (X) |
| 19 | 325 | 3.9 | (X) |
| 20 | 400 | 2.6 | (X) |
| 21 | 400 | 2.7 | (X) |
| 22 | 450 | 6.8 | (Δ) |

As shown in Table 4, in the case of the printing aluminum alloy material plates.

(Sample Nos. 12 to 17 and 22), it is clear that they are excellent in the burning ability since they have large yield-stress in burning ability. Meanwhile, the comparative alloy samples (Sample Nos. 18 to 21) are all inferior in yield-stress testing after burning treatment since the Si content does not satisfy the expression (2) in relation to the temperature of intermediate annealing.

Although exemplification is shown, in the abovementioned example, such that the intermediate annealing is conducted under stationary batch type annealing, the intermediate annealing can be also made by the so-called continuous annealing process in which the material is passed through a heating furnace held at a high temperature while the material is being uncoiled so as to be annealed.

As can be clearly understood from the above, since the printing aluminum alloy material plates according to the present invention are excellent in burning ability, the lowering of mechanical strength after the burning treatment is slight, and therefore, the burning treatment can be carried out at a high temperature in a short time to enhance the press life and as well to shorten the burning time. Thus, satisfactory printed materials can be obtained after printing by the printing plate using the material plates according to the present invention. Accordingly, the printing aluminum alloy material plates of the present invention are very useful for the support members for off-set printing or lithographic printing.

EXAMPLE 3

Alloys according to the present invention and comparative alloys as indicated by sample numbers 23 to 33 in Table 5 are molten, and are cast, by semi-continuous casting, into slabs of 450 mm×1200 mm×3500 mm. Each slab, after being subjected to scalping by 7 mm per one surface, is subjected to uniformalizing at 550° C. for 12 hours, and then is initiated to be hot-rolled at 500° C. to produce a rolled plate having a plate-thickness of 5 mm. Then, after being subjected to cold-rolling to a plate-thickness of 1.2 mm, the plate is subjected to intermediate annealing in a stationary type annealing furnace at a temperature indicated in Table 6. The temperature increasing rate of this stationary type annealing is about 50° C./Hr, and the holding time after reaching of the annealing temperature is 2 hours. Then the coil after intermediate annealing is cold-rolled to provide a plate-thickness of 0.3 mm so as to obtain offset-printing material plates.

Each material plate obtained in this example, after being mechanically surface-roughened by brushing, is preetched in 10% NaOH aqueous solution at 50° C. for 1 minute, and is then subjected to surface-roughening, electrochemically by carrying out A.C. electrolyzation with the use of nitric acid type etching liquid at 35° C. Thereafter, an anodic oxidation coating having a thickness of 1 μm is formed on the material plate by anodic oxidation in 15% $H_2SO_4$ aqueous solution, and then photosensitizer is coated on the material plate so as to obtain an offset-printing PS plate. The thus-obtained PS plate, after being subjected to predetermined exposure and development, is subjected to a burning treatment at 280° C. for 7 minutes. With the use of the thus obtained original plate, a printing test of 100,000 copies is carried out under the presence of dampening water.

The results of examination concerning these alloys according to the present invention and comparative alloys are listed in Table 6. The evaluation to the ink-stain resistivity is made by checking stains on the non-image section of the printing plate after the printing of 100,000 copies, and satisfactory or unsatisfactory results are indicated by "O" and "X" marks, respectively.

TABLE 5

| Sample No. | Material Composition (wt %) | | | | | |
|---|---|---|---|---|---|---|
| | Si | Fe | Cu | Mg | Ti | B |
| 23 | 0.05 | 0.25 | 0.012 | 0.002 | 0.03 | 0.0002 |
| 24 | 0.03 | 0.30 | 0.024 | 0.005 | 0.02 | 0.001 |
| 25 | 0.06 | 0.41 | 0.008 | 0.003 | 0.03 | 0.002 |
| 26 | 0.03 | 0.31 | 0.012 | 0.002 | 0.03 | 0.0002 |
| 27 | 0.06 | 0.42 | 0.002 | 0.012 | 0.04 | 0.005 |
| 28 | 0.10 | 0.68 | 0.010 | 0.002 | 0.04 | 0.005 |
| 29 | 0.07 | 0.10 | 0.014 | 0.004 | 0.05 | 0.0002 |
| 30 | 0.04 | 0.53 | 0.013 | 0.010 | 0.03 | 0.004 |
| 31 | 0.16 | 0.95 | 0.006 | 0.002 | 0.05 | 0.001 |
| 32 | 0.10 | 0.32 | 0.003 | 0.014 | 0.03 | 0.001 |
| 33 | 0.10 | 0.43 | 0.002 | 0.014 | 0.01 | 0.001 |

TABLE 6

| Sample No. | Intermediate Annealing Temperature (°C.) | Ink Stain Resistivity |
|---|---|---|
| 23 | 450 | ○ |
| 24 | 500 | ○ |
| 25 | 475 | ○ |
| 26 | 500 | ○ |
| 27 | 475 | ○ |
| 28 | 450 | X |
| 29 | 350 | ○ |
| 30 | 325 | ○ |
| 31 | 400 | X |
| 32 | 400 | X |
| 33 | 450 | X |

As shown in Table 6 in the case of the printing aluminum alloy material plates (Sample Nos. 23 to 27, 29, and 30) it is clear that they are excellent in the ink stain resistivity. Meanwhile, the comparative alloy samples (Sample Nos. 28, 31, 32 and 33) are inferior in the ink stain resistivity, since the Si content exceeds 0.08 wt %.

Although exemplification is shown, in the abovementioned reference example, such that the intermediate annealing is conducted under stationary batch type annealing, it is natural that the intermediate annealing can be also made by the so-called continuous annealing process in which the material is passed through a heating furnace held at a high temperature while the material being uncoiled in order to be annealed.

As is clearly understood from the above, since the printing aluminum alloy material plates according to the present invention are excellent in ink strain resistivity so that stains on the printed matters due to adhesion of ink to the non-imaged surface during printing can be effectively prevented, therefore satisfactory printed material can be obtained after printing by the printing plate using these material plates. Accordingly, the printing aluminum alloy material plate of the present invention are very useful for the support members for off-set printing or lithographic printing.

EXAMPLE 4

Figure 6:
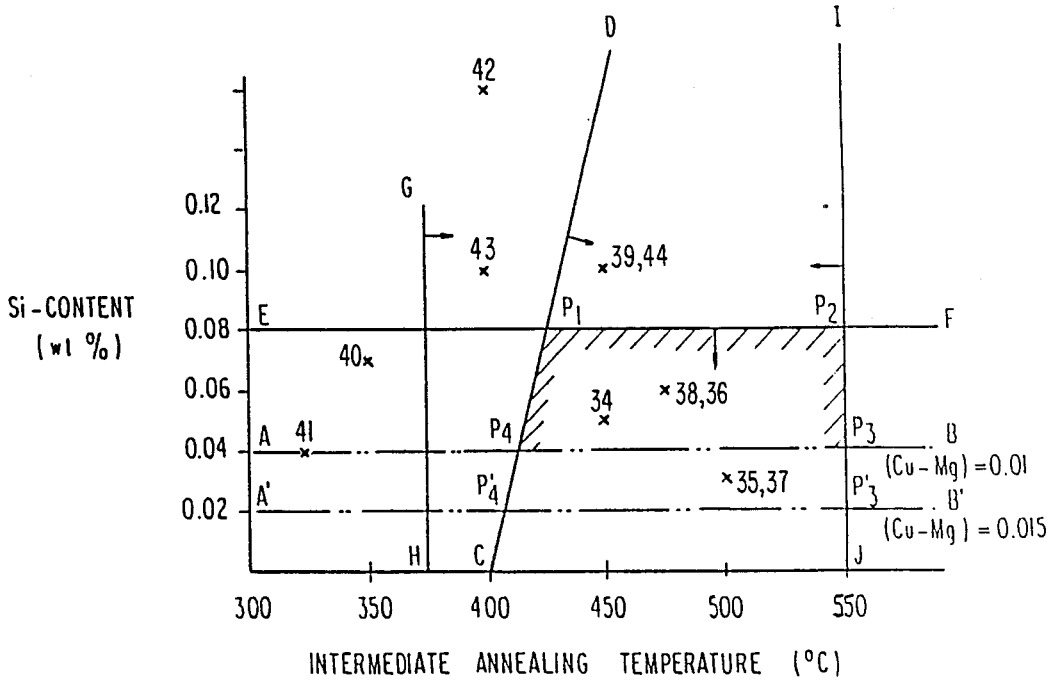

Alloys according to the present invention and comparative alloys as indicated by sample numbers 34 to 44 in Table 7 are molten, and were cast, by semi-continuous casting, into slabs of 450 mm×1200 mm×3500 mm. Each slab, after being subjected to scalping by 7 mm per one surface, were subjected to uniformalizing at 550° C. for 12 hours, and then is initiated to be hot-rolled at 500° C. to produce a rolled plate having a plate-thickness of 5 mm. Then, after being subjected to cold-rolling to a plate-thickness of 1.2 mm, the plate was subjected to intermediate annealing in a stationary type annealing furnace at a temperature indicated in Table 8. The temperature increasing rate of this stationary type annealing is about 50° C./Hr, and the holding time after reaching the annealing temperature is 2 hours. Then the coil after intermediate annealing is cold-rolled to a plate-thickness of 0.3 mm so as to obtain offset-printing material plates. The Si content and the temperature of intermediate annealing for these material plates of the sample numbers of 34 to 44 are plotted with x-marks in FIG. 6. In FIG. 6, the line A–$P_4$–$P_3$–B denotes the lower limit of Si content (0.04 wt %) in accordance with the abovementioned expression (1) when the amount of (Cu wt %-Mg wt %) is 0.01 wt % and the line A'–$P_4$'–$P_3$'–B' also denotes the lower limit of Si content (0.02 wt %) in accordance with the expression (1) when the amount of (Cu wt %-Mg wt %) is 0.015 wt %.

Each material plate obtained in this example, after being mechanically surface-roughened by brushing, was preetched in 10% NaOH aqueous solution at 50° C. for 1 minute and then was subjected to surface-roughening, electrochemically by carrying out A.C. electrolyzation with the use of nitric acid type etching liquid at 35° C. Thereafter, an anodic oxidation coating having a thickness of 1 μm was formed on the material plate by anodic oxidation in 15% $H_2SO_4$ aqueous solution, and then photosensitizer was coated on the material plate so as to obtain an offset-printing PS plate. The thus-obtained PS plate, after being subjected to predetermined exposure and development, was subjected to burning treatment at 280° C. for 7 minutes. With the use of the thus obtained original plate, a printing test of 100,000 copies was carried out under the presence of dampening water.

The results of examination concerning these alloys according to the present invention and comparative alloys are listed in Table 8. The evaluation to the surfacetreatment ability is made by checking whether uniformity in surface-roughness after electrochemical surface-roughening can be obtained or not, and satisfactory or unsatisfactory results are indicated by "O" and "X" marks, respectively.

TABLE 7

| Sample No. | Material Composition (wt %) | | | | | | |
|---|---|---|---|---|---|---|---|
| | Si | Fe | Cu | Mg | (Cu—Mg) | Ti | B |
| 34 | 0.05 | 0.25 | 0.012 | 0.002 | 0.010 | 0.03 | 0.0002 |
| 35 | 0.03 | 0.30 | 0.024 | 0.005 | 0.019 | 0.02 | 0.001 |
| 36 | 0.06 | 0.41 | 0.008 | 0.003 | 0.005 | 0.03 | 0.002 |
| 37 | 0.03 | 0.31 | 0.012 | 0.002 | 0.010 | 0.03 | 0.0002 |
| 38 | 0.06 | 0.42 | 0.002 | 0.012 | −0.010 | 0.04 | 0.005 |
| 39 | 0.10 | 0.68 | 0.010 | 0.002 | 0.008 | 0.04 | 0.005 |
| 40 | 0.07 | 0.10 | 0.014 | 0.004 | 0.010 | 0.05 | 0.0002 |
| 41 | 0.04 | 0.53 | 0.013 | 0.010 | 0.003 | 0.03 | 0.004 |
| 42 | 0.16 | 0.95 | 0.006 | 0.002 | 0.004 | 0.05 | 0.001 |
| 43 | 0.10 | 0.32 | 0.003 | 0.014 | −0.011 | 0.03 | 0.001 |
| 44 | 0.10 | 0.43 | 0.002 | 0.014 | −0.012 | 0.01 | 0.001 |

TABLE 8

| Sample No. | Intermediate Annealing Temperature (°C.) | Surface-Treatment Ability | Proof Strength after Burning ($Kg/mm^2$) | | Ink Stain Resistivity |
|---|---|---|---|---|---|
| 34 | 450 | ○ | 12.1 | (○) | ○ |
| 35 | 500 | ○ | 13.5 | (○) | ○ |
| 36 | 475 | ○ | 12.3 | (○) | ○ |
| 37 | 500 | X | 13.4 | (○) | ○ |
| 38 | 475 | X | 12.4 | (○) | ○ |
| 39 | 450 | ○ | 8.6 | (Δ) | X |
| 40 | 350 | ○ | 2.8 | (X) | ○ |
| 41 | 325 | X | 3.9 | (X) | ○ |

TABLE 8-continued

| Sample No. | Intermediate Annealing Temperature (°C.) | Surface-Treatment Ability | Proof Strength after Burning ($Kg/mm^2$) | | Ink Stain Resistivity |
|---|---|---|---|---|---|
| 42 | 400 | ○ | 2.6 | (X) | X |
| 43 | 400 | X | 2.7 | (X) | X |
| 44 | 450 | X | 6.8 | (Δ) | X |

The strength after burning is shown as the values of 0.2% yield-stress after burning treatment at 280° C. for 7 minutes. Further, the evaluation to the ink stain resistivity was made by checking stains on the non-imaged section of the printing plate after printing of 100,000 copies, and satisfactory and unsatisfactory results are indicated by "O" and "X" marks, respectively.

As shown in Table 8, in the case of printing aluminum alloy material plates (Sample Nos. 34, 35 and 36) it is clear that they are excellent in the surface-treatment ability, burning ability, and the ink stain resistivity. Meanwhile, the comparative alloy samples (Sample Nos. 37, 38, 41, 43 and 44) were inferior in the surface-treatment ability, since Si content does not satisfy the expression (1) in relation to the amount of (Cu wt %-Mg wt %). The comparative samples (Sample Nos. 40, 41, 42 and 43) were inferior in yield-stress after burning treatment since Si content does not satisfy the expression (2) in relation to the temperature of intermediate annealing, and the comparing alloy samples (Sample Nos. 39, 42, 43 and 44) are inferior in the ink stain resistivity since Si content exceeds 0.08 wt %. Accordingly, in order to satisfy all of the surface-treatment ability, the burning ability, and the ink stain resistivity, all conditions proposed by the present invention should preferably be satisfied.

Although exemplification is shown, in the abovementioned example, such that the intermediate annealing was conducted as stationary batch type annealing, the intermediate annealing can be also made by the so-called continuous annealing process in which the material is passed through a heating furnace held at a high temperature while the material is uncoiled so as to be annealed.

As clearly understood from the above, since the printing aluminum alloy material plates according to the present invention are excellent in the surface-treatment ability for surface-roughening, surface-roughness can be uniformly formed without irregularity by surface-roughening while a suitable color tone is possibly obtained after surface-roughening. Further, they are also excellent in burning ability, that is, the lowering of mechanical strength after burning treatment is slight, and therefore the burning treatment can be conducted at a high temperature in a short time in order to enhance the press life and as well to shorten the time of the burning treatment. Further they are also excellent in the ink stain resistivity, and therefore stains on the printed material due to adhesion of ink to the non-imaged section of printing plate during printing can be effectively prevented. Therefore, satisfactory printed materials can be obtained after printing by the printing plate using the material plates. Accordingly, the printing aluminum alloy material plates of the present invention are very useful for the support members for offset printing or flat-plate printing.

Although the invention has been described in connection with certain specific embodiments, it is readily apparent to those skilled in the art that various changes in form and arrangement may be made without departing from the spirit and scope of the invention.

While the invention has been described in detail and with reference to specific embodiments thereof, it will be apparent to one skilled in the art that various changes and modifications can be made therein without departing from the spirit and scope thereof.

What is claimed is:

1. A lithographic printing plate support consisting essentially of Al, Si, Fe, Cu, Ti, Mg, and unavoidable impurities, wherein Si is present in an amount up to 0.25 wt %, Fe is present in an amount of from 0.05 to 1.0 wt %, Cu is present in an amount of up to 0.03 wt %, Ti is present in an amount up to 0.10 wt %, Mg is present in an amount up to 0.03 wt % and the balance of unavoidable impurities and Al, and the amounts of Si, Cu and Mg satisfy the following expression:

$$\text{Si wt } \% \geqq 0.08 \text{ wt } \% - 4(\text{Cu wt } \% - \text{Mg wt } \%)$$

the amount of Si also satisfies the following expression:

$$0.25 \geqq \text{Si wt } \% \leqq 2T/625 - 128$$

wherein T is the temperature in °C. of an intermediate annealing step used in production of the lithographic printing plate, T being between 300° and 550° C., and wherein the difference between the Cu wt % and Mg wt % is in a range which satisfies the following expression:

$$0 \leqq (\text{Cu wt } \% - \text{Mg wt } \%) \leqq 0.03.$$

2. A lithographic printing plate support as claimed in claim 1, wherein the amount of Si is up to 0.08 wt %.

* * * * *